United States Patent [19]

Ito et al.

[11] Patent Number: 4,508,086

[45] Date of Patent: Apr. 2, 1985

[54] METHOD OF ELECTRONICALLY CONTROLLING FUEL INJECTION FOR INTERNAL COMBUSTION ENGINE

[75] Inventors: Toshimitsu Ito; Kazuhiko Norota, both of Toyota, Japan

[73] Assignee: Toyota Jidosha Kabushiki Kaisha, Toyota, Japan

[21] Appl. No.: 607,307

[22] Filed: May 4, 1984

[30] Foreign Application Priority Data

| | | | |
|---|---|---|---|
| May 9, 1983 | [JP] | Japan | 58-80622 |
| May 9, 1983 | [JP] | Japan | 58-80623 |
| May 9, 1983 | [JP] | Japan | 58-80624 |
| May 9, 1983 | [JP] | Japan | 58-80625 |

[51] Int. Cl.[3] ..... F02B 3/00; F02B 33/00

[52] U.S. Cl. ..... 123/492; 123/493; 123/494

[58] Field of Search ..... 123/492, 493, 494, 480

[56] References Cited

U.S. PATENT DOCUMENTS

| | | | |
|---|---|---|---|
| 4,077,364 | 3/1978 | Aoki | 123/492 |
| 4,399,790 | 8/1983 | Ktaoka | 123/492 |
| 4,408,588 | 10/1983 | Mausner | 123/492 |
| 4,416,240 | 11/1983 | Matsuoka | 123/492 |
| 4,457,283 | 7/1984 | Kubayashi et al. | 123/492 |
| 4,463,732 | 8/1984 | Uoba et al. | 123/492 |

*Primary Examiner*—Raymond A. Nelli

*Attorney, Agent, or Firm*—Cushman, Darby & Cushman

[57] ABSTRACT

Fuel is injected in synchronism with the crank angle. In addition, an engine acceleration state is detected from the second-order differential value of the intake-pipe pressure, and the quantity of the asynchronous fuel injection in which fuel is injected in asynchronism with the crank angle is increased in an early stage of acceleration but is decreased after the early stage of acceleration. Moreover, no asynchronous injection is carried out in a low engine speed region. It is thereby possible to obtain an optimum air-fuel ratio in accordance with the engine acceleration state.

16 Claims, 13 Drawing Figures

METHOD OF ELECTRONICALLY CONTROLLING FUEL INJECTION FOR INTERNAL COMBUSTION ENGINE

BACKGROUND OF THE INVENTION

1. Field of the Invention

The present invention relates to a method of electronically controlling the fuel injection for an internal combustion engine, and more particularly, to a method of electronically controlling the fuel injection for an internal combustion engine adapted to perform a synchronous injection that fuel is injected at a predetermined period in accordance with the crank angle and an asynchronous injection that fuel is injected in asynchronism with the crank angle in acceleration.

2. Description of the Prior Art

Hitherto, such a fuel injection method is known that a fuel injection valve is provided on each of cylinders so as to project into an intake manifold, and signals fed from various sensors are processed by means of a microcomputer to judge an engine operating condition and inject fuel in amount in accordance with the operating condition. In this fuel injection method, a synchronous injection and an asynchronous injection are effected. The synchronous injection is such that fuel is injected into all cylinders simultaneously or for each specific cylinder at a predetermined period, while the asynchronous injection is such that fuel is injected in acceleration independently of the synchronous injection. More specifically, in the synchronous injection, a basic fuel injection pulse width is calculated in accordance with the engine load (the pressure in the intake pipe or the quantity of the intake air per revolution of the engine shaft) and the engine speed, as well as corrected by employing a partial lean correction coefficient, a feedback correction coefficient and other correction coefficient determined by the cooling water temperature or the like, thereby to obtain a fuel injection pulse width and a fuel injection valve is opened to inject fuel for a period of time corresponding to the fuel injection pulse width at a predetermined crank angle. On the other hand, the asynchronous injection during acceleration is effected in order to improve the engine responsiveness and the like during acceleration. In the asynchronous injection, a linear throttle sensor is attached which outputs a voltage as a linear function with respect to the throttle opening, and fuel is injected in accordance with the rate of change of the output voltage and that of the engine load independently of the synchronous injection. Since this asynchronous injection makes it possible to correct the air-fuel ratio during a transient period in the early stage of acceleration, driveability and the exhaust emission control are improved.

In the above conventional fuel injection method, however, there is a disadvantage that in the case of acceleration from a light-load operation region, the intake-pipe pressure and the intake-air quantity exceedingly increase with a slight increase in the throttle opening, so that the air-fuel ratio during acceleration cannot be properly controlled in accordance with the acceleration state.

SUMMARY OF THE INVENTION

Accordingly, an object of the present invention is to provide a method of electronically controlling the fuel injection for an internal combustion engine, which makes it possible to improve the driveability and the exhaust emission control during acceleration of the engine by properly controlling the air-fuel ratio during acceleration in accordance with the acceleration state, thereby to obviate the above-mentioned disadvantage of the prior art.

To this end, according to a first aspect of the present invention, there is provided a method of electronically controlling the fuel injection for an internal combustion engine wherein fuel is injected in asynchronism with the crank angle when a throttle valve is open and the first-order differential value of the engine load with respect to time takes a positive value, comprising the steps of: injecting a first quantity of fuel during the period from the point of time when the throttle valve at fully closed position is opened until a predetermined period of time has elapsed and when the second-order differential value of the engine load with respect to time is not less than a first reference value and the third-order differential value of the engine load with respect to time is not negative; and injecting a second quantity of fuel after the predetermined period of time has elapsed and when the second-order differential value is not less than a second reference value and the third-order differential value is not negative. In this case, the first-order differential value of the engine load with respect to time means the rate of change or quantity of change of the engine load with respect to a predetermined period of time; the second-order differential value of the engine load with respect to time means the quantity of change of the first-order differential value with respect to a predetermined period of time; and the third-order differential value of the engine load with respect to time means the quantity of change of the second-order differential value with respect to a predetermined period of time.

According to the first aspect of the present invention, an engine acceleration state is detected from the second-order differential value of the engine load with respect to time, and the asynchronous injection is effected when the third-order differential value of the engine load with respect to time is not negative. It is, therefore, possible to obtain such a characteristic advantage that the asynchronous injection is effected only in the early stage of acceleration, and a proper air-fuel ratio can be obtained in accordance with the acceleration state.

Further, according to a second aspect of the present invention, there is provided a method of electronically controlling the fuel injection for an internal combustion engine wherein fuel is injected in asynchronism with the crank angle when a throttle valve is open and the rate of change of the engine load takes a positive value, comprising the steps of: injecting a first quantity of fuel during the period from the point of time when the throttle valve at fully closed position is opened and until a predetermined period of time has elapsed and when the rate of change of the change rate of the engine load is not less than a first reference value; and injecting a second quantity of fuel after the predetermined period of time has elapsed and when the rate of change of the change rate of the engine load is not less than a second reference value.

According to the second aspect of the present invention, an engine acceleration state is detected from the rate of change of the change rate of the engine load, and the fuel injection quantity is made to differ between the engine operation in the early stage of acceleration and that after the acceleration early stage. It is, therefore, possible to obtain such a characteristic advantage that an engine acceleration state can be detected with a high accuracy, and a proper air-fuel ratio can be obtained in accordance with the acceleration state.

Furthermore, according to a third aspect of the present invention, there is provided a method of electronically controlling the fuel injection for an internal combustion engine wherein fuel is injected in asynchronism with the crank angle when a throttle valve is open and the rate of change of the engine load takes a positive value, comprising the steps of: obtaining a time based on the point of time when the throttle valve at fully closed position is open, as well as determining a reference value which is increased with the time; injecting a first quantity of fuel when the above-mentioned time is not exceeding a predetermined period time and the rate of change of the change rate of the engine load is not less than the reference value; and injecting a second quantity of fuel when the above-mentioned time exceeds the predetermined period of time and the rate of change of the change rate of the engine load is not less than the reference value.

According to the third aspect of the present invention, an engine acceleration state is detected from the rate of change of the change rate of the engine load, and the reference value in the early stage of acceleration is made small, while the reference value after the acceleration early stage is made large. It is, therefore, possible to obtain such a characteristic advantage that the number of times of asynchronous injections in the acceleration early stage is increased, and a proper air-fuel ratio can be obtained in accordance with the acceleration state.

Moreover, according to the present invention, the above-mentioned reference value is determined so as to be increased in accordance with a time based on the point of time when the throttle valve at fully closed position is opened, and further increased after the injection of fuel, thereby to effect the above-mentioned fuel injection control. Accordingly, the reference value is increased after the asynchronous injection, and hence, the number of times of asynchronous injections is reduced. Thus, it is possible to obtain a proper air-fuel ratio in accordance with the engine acceleration state.

The above-mentioned engine load can be detected from the intake-pipe pressure, the intake-air quantity per revolution of the engine shaft, the throttle opening and the fuel injection pulse width. Further, in the present invention, it is preferable to set the first quantity as a predetermined quantity and increase the second quantity in accordance with the rate of change of the change rate of the engine load. In addition, the reference value may be further increased in the low engine speed region.

DETAILED DESCRIPTION OF THE INVENTION

Figure 1:
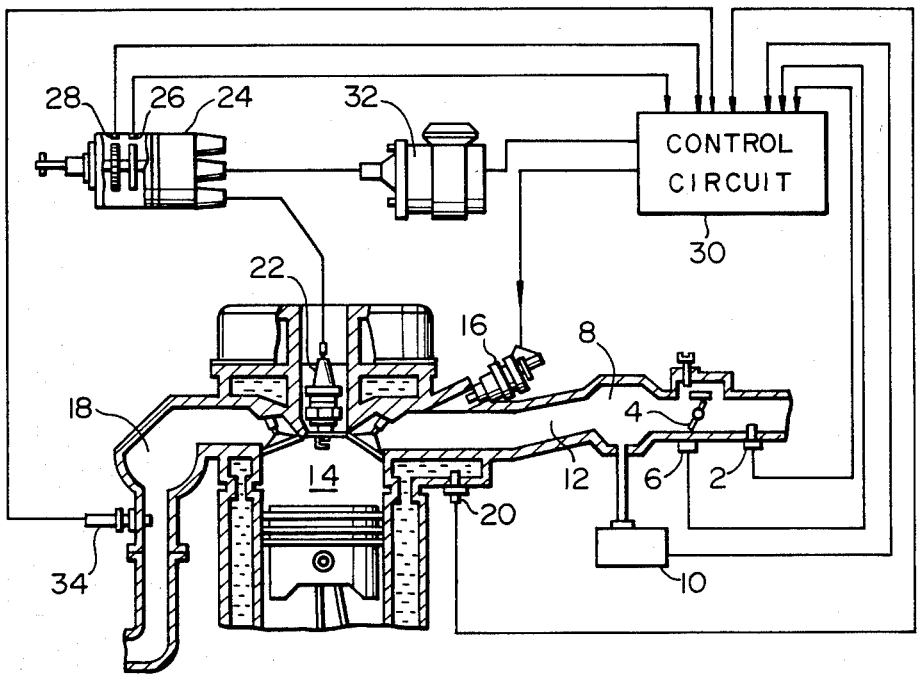
FIG. 1 is a schematic illustration of an example of an engine to which the present invention is applied.

An example of an internal combustion engine (referred to as simply "engine", hereinafter) to which the present invention is applied will be described hereinunder in detail with reference to FIG. 1. An intake-air temperature sensor 2, which detects the temperature of the intake air and delivers an intake-air temperature signal, is provided on the downstream side of an air cleaner (not shown). On the downstream side of the intake-air temperature sensor 2 is disposed a throttle valve 4, which is equipped with a throttle switch 6 which is interlocked with the throttle valve 4 and adapted to be made ON when the throttle valve 4 is at fully closed position and made OFF when the throttle valve 4 is opened. On the downstream side of the throttle valve 4 is provided a surge tank 8, which is equipped with a pressure sensor 10 which detects the intake-pipe pressure on the downstream side of the throttle valve 4 and delivers an intake-pipe pressure signal. The surge tank 8 is communicated with a combustion chamber 14 in the engine through an intake manifold 12. The intake manifold 12 has a fuel injection valve 16 provided for each of cylinders. The combustion chamber 14 in the engine is communicated with a catalytic converter (not shown) filled with a three-way catalyst through an exhaust manifold. Further, the engine block is equipped with a water temperature sensor 20 which detects the temperature of water for cooling the engine and delivers a water temperature signal. The end of a spark plug 22 is projected into the combustion chamber 14 in the engine, and a distributor 24 is connected to the spark plug 22. The distributor 24 is provided with a cylinder discriminating sensor 26 and an engine speed sensor 28 each constituted by a pickup secured to the distributor housing and a signal rotor secured to the distributor shaft. The cylinder discriminating sensor 26 delivers a cylinder discriminating signal every 720° CA, for example, to a control circuit 30 constituted by a microcomputer or the like, while the engine speed sensor 28 delivers a crank angle signal every 30° CA, for example, to the control circuit 30. In addition, the distributor 24 is connected to an ignitor 32. It is to be noted that a reference numeral 34 denotes an $O_2$ sensor which detects the residual oxygen concentration in an exhaust gas and delivers an air-fuel ratio signal.

Figure 2:
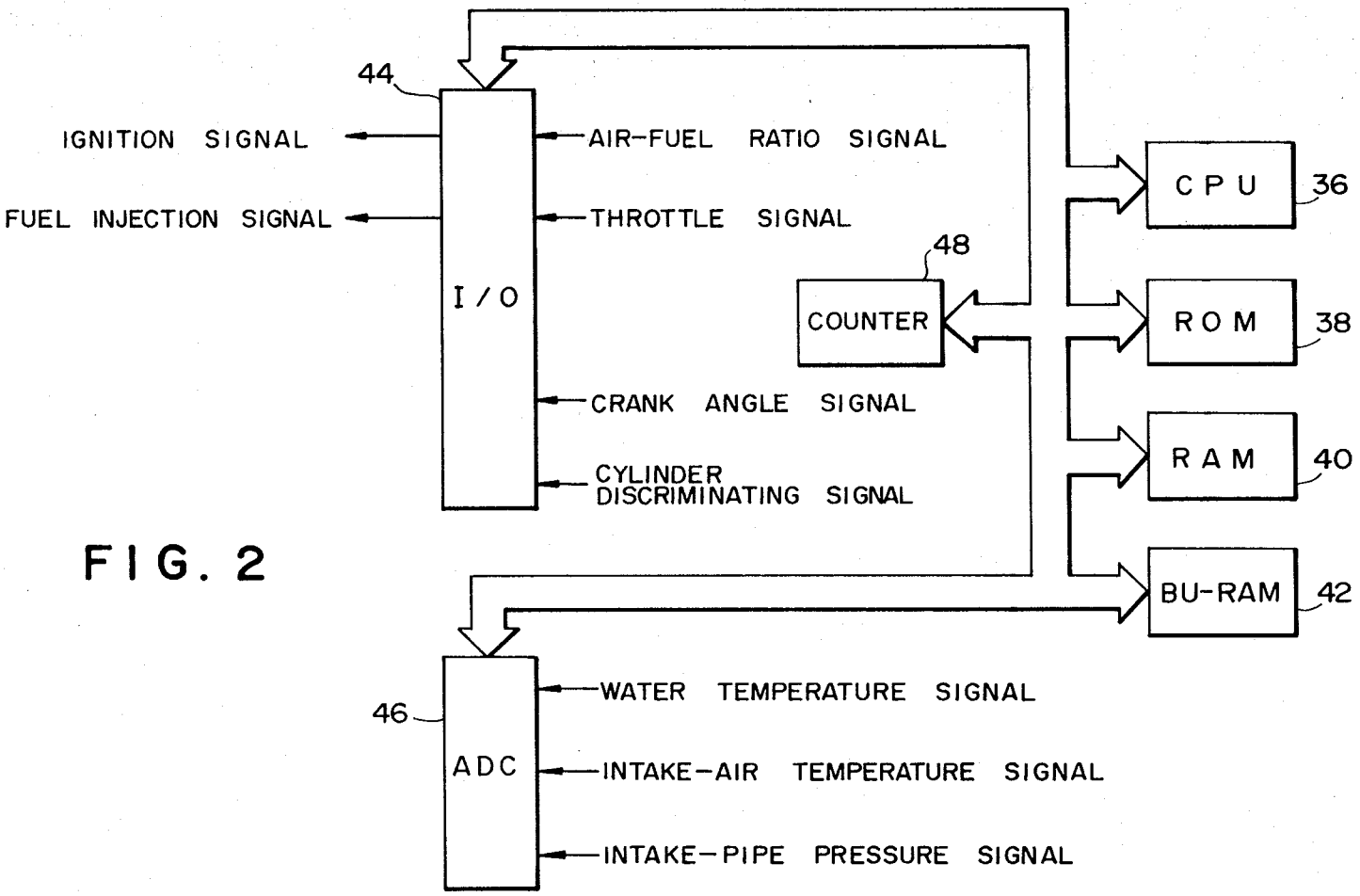
FIG. 2 is a block diagram of a control circuit shown in FIG. 1.

The control circuit 30 includes, as shown in FIG. 2, a central processing unit (CPU) 36, a read-only memory (ROM) 38, a random-access memory (RAM) 40, a backup RAM (BU-RAM) 42, an input/output port (I/O) 44, an anlalog-to-digital converter (ADC) 46 and buses, such as a data bus and a control bus for connecting these components to each other. Fed into the I/O 44 are the cylinder discriminating signal, the crank angle signal, the air-fuel ratio signal, and the throttle signal delivered from the throttle switch 6. Delivered from the I/O 44 are a fuel injection signal for controlling the opening/closing timings of the fuel injection valve 16 through a driving circuit and an ignition signal for controlling the ON/OFF timings of the ignitor 32. Further, the intake-pipe pressure signal, the intake-air temperature signal and the water temperature signal are fed into the ADC 46 and converted into digital signals, respectively.

The crank angle signal is fed into the I/O 44 through a waveform shaping circuit. From the crank angle signal, a digital signal representative of the engine speed is formed. The cylinder discriminating signal is fed into the I/O 44 in the same manner as the above and converted into a digital signal. The cylinder discriminating signal, together with the crank angle signal, is utilized to form an interruption request signal for calculation of a basic fuel injection pulse width, a fuel injection start signal and so forth. The ON/OFF signal from the throttle switch 6 is fed into a predetermined bit position in the I/O 44 and temporarily stored therein. Moreover, the I/O 44 is provided therein with a known fuel injection control circuit including a presettable counter and a register. The fuel injection control circuit forms, from binary data on the injection pulse width fed thereinto from the CPU 36, an injection pulse signal having the injection pulse width, and feeds the injection pulse signal to the fuel injection valves 16 successively or simultaneously, thereby to energize the injection valves 16. As a result, fuel in quantity in accordance with the pulse width of the injection pulse signal is injected synchronously or asynchronously. The ROM 38 has previously stored therein a main processing routine program, an interruption processing routine program for calculation of the fuel injection pulse width, an interruption processing routine program for calculation of coefficients, such as a partial lean correction coefficient, other programs, and various data necessary for each of the above operational processings. The ROM 38 further has previously stored therein data on first and second quantities, first and second reference values $L_1$, $L_2$ and so forth for the asynchronous fuel injection. In addition, a reference numenal 48 denotes a counter.

Figure 3:
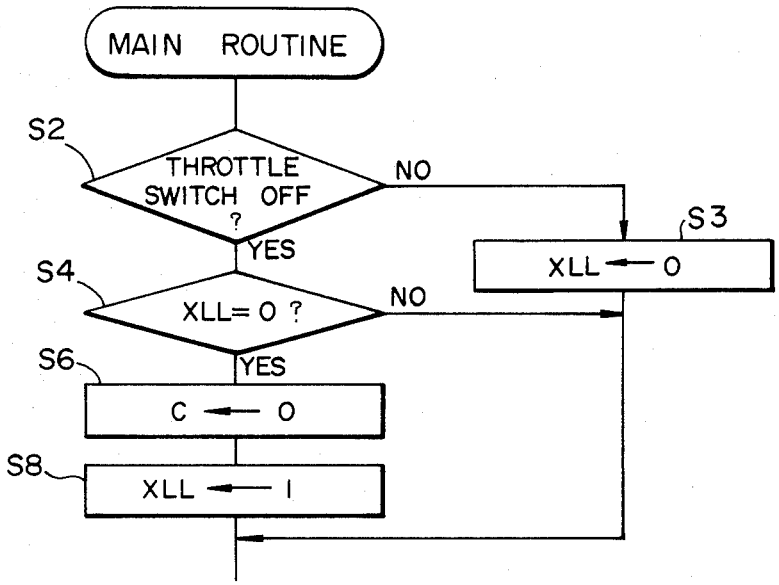
FIG. 3 is a flow chart of a main routine in accordance with a first embodiment of the invention.

The asynchronous injection routine in accordance with a first embodiment of the present invention will be explained hereinunder with reference to FIGS. 3 to 5. It is to be noted that since the synchronous injection routine is the same as the conventional one, the description thereof is omitted. Referring now to FIG. 3, which shows a main routine, a judgement is made in a step S2 as to whether the throttle switch 6 is ON or OFF, that is, whether the throttle valve is open or closed, in accordance with the throttle signal. If the throttle switch is ON, the process proceeds to a step S3 in which a flag XLL is reset, and then proceeds to the next routine. If the throttle switch is OFF, a judgement is made in a step S4 as to whether the flag XLL, which is set when the throttle switch is OFF, is reset or not. If the flag XLL is set, the process proceeds to the next routine. If the flag XLL is reset, that is, if the throttle switch is ON the last time, the counter is cleared in a step S6, and the flag XLL is set in a step S8. Accordingly, the counter counts at all times and is cleared at the point of time when the throttle switch changes from ON to OFF. In other words, the counter counts a period of time based on the point of time when the throttle switch changes from ON to OFF, that is, the throttle valve at fully closed position is opened.

Figure 4:
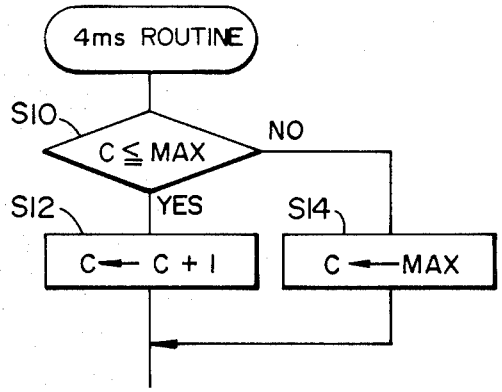
FIG. 4 is a flow chart of a 4 msec routine in accordance with the first embodiment.

FIG. 4 shows a routine for incrementing the counter every predetermined period of time. In this embodiment, the count C is incremented every 4 msec in a step S12. It is to be noted that the overflow of the counter is prevented by limiting the count C by the counter to a maximum value MAX in a step S10 and a step S14.

Figure 5:
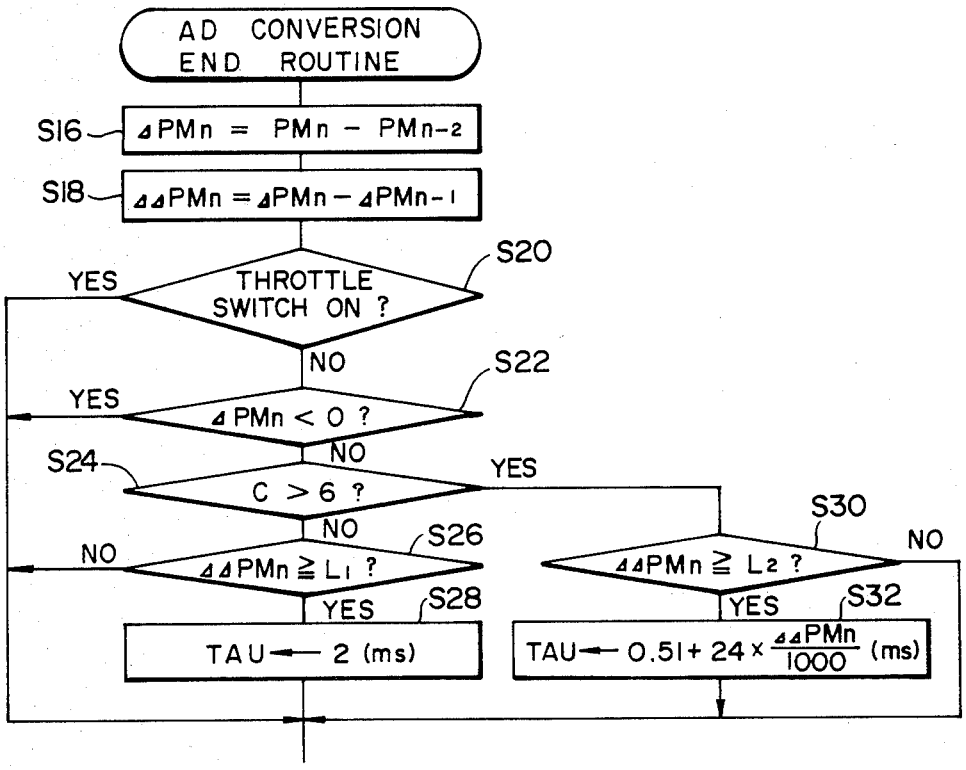
FIG. 5 is a flow chart of an asynchronous injection routine in accordance with the first embodiment.

FIG. 5 shows a routine for calculating a pulse width TAU of the fuel injection signal in the asynchronous injection through judgement of an engine acceleration state. This routine is interrupted when the AD conversion of the intake-pipe pressure PM is completed. It is to be noted that the AD conversion of the intake-pipe pressure PM is executed every 12 msec. In a step S16, calculation is carried out to obtain the difference between an intake-pipe pressure PMn measured this time and an intake-pipe pressure PMn-2 measured before the last time, that is, 24 msec before, to calculate the quantity of change of the intake-pipe pressure during 24 msec, that is, the change rate ΔPMn. This change rate ΔPMn is equivalent to the first-order differential of the intake-pipe pressure PM with respect to time. In a step S18, calculation is carried out to obtain the difference between the change rate ΔPMn calculated this time and the change rate ΔPMn-1 calculated the last time, that is, 12 msec before to calculate the quantity of change in the change rate during 12 msec, that is, the rate ΔΔPMn of change of the change rate of the intake-pipe pressure. This change rate ΔΔPMn is equivalent to the second-order differential of the intake-pipe pressure PM with respect to time.

Accordingly, in the following description, the change rates ΔPMn, ΔΔPMn will be referred to as "first-order differential value" and "second-order differential value", respectively.

In a step S20, a judgement is made as to whether the throttle switch is ON or OFF, and a judgement is made in a step S22 as to whether the first-order differential value ΔPMn of the intake-pipe pressure is negative or not. Only when the throttle switch is OFF and the first-order differential value ΔPMn is not less than zero, the following steps are executed. Accordingly, when the first-order differential value ΔPMn is negative, that is, during deceleration, no asynchronous injection is effected. In a subsequent step S24, a judgement is made as to whether the count C by the counter exceeds a predetermined value (six, for example) or not. If the count C is not exceeding six, the process proceeds to a step S26. If the count C exceeds six, the process proceeds to a step S30.

In the step S26, a judgement is made as to whether the second-order differential value ΔΔPMn of the intake-pipe pressure is not less than the first reference value $L_1$ (a positive value). Only when the second-order differential value ΔΔPMn is not less than the first reference value $L_1$, the process proceeds to a step S28 in which the asynchronous injection pulse width TAU is set at a predetermined value (2 msec, for example). As a result, the first quantity of fuel corresponding to the asynchronous injection pulse width (2 msec) is asynchronously injected during an acceleration period from the point of time when the throttle valve at fully closed position is opened until a predetermined period of time (24 msec) has elapsed.

In the step S30, on the other hand, a judgement is made as to whether the second-order differential value ΔΔPMn of the intake-pipe pressure is not less than the second reference value $L_2$ (a positive value). Only when the second-order differential value ΔΔPMn is not less than the second reference value $L_2$, the process proceeds to a step S32 in which the asynchronous injection pulse width TAU is determined by the following equation:

$$TAU = 0.51 + 24 \frac{\Delta\Delta PMn}{1000} \quad (1)$$

It is to be noted that in the above equation the coefficients 0.51, 24 are determined through experiments, while the coefficient 1000 is a constant for converting the asynchronous injection pulse width TAU into a time in the unit of msec. As a result, after the above-mentioned predetermined period of time has elapsed, the second quantity of fuel is injected corresponding to the asynchronous injection pulse width TAU proportional to the second-order differential value ΔΔPMn of the intake-pipe pressure.

It is to be noted that since the reference values $L_1$, $L_2$ are set to be positive, no asynchronous injection is carried out during the stationary traveling state (ΔPM=0) and a slow acceleration (ΔPM=constant) in which ΔΔPM is zero.

A second embodiment of the present invention will be explained hereinunder. Since the main routine and 4 msec routine in accordance with this embodiment are the same as those shown in FIGS. 3 and 4, respectively, the description thereof is omitted. The ROM 38 has previously stored therein data on the first and second quantities for the asynchronous fuel injection and a map shown in FIG. 6. This map is employed for determination of a reference value L with respect to the count C by the counter for counting a period of time based on the point of time when the throttle valve at fully closed position is opened, and is determined so that the reference value L stepwisely increases as the count C increases.

Figure 7:
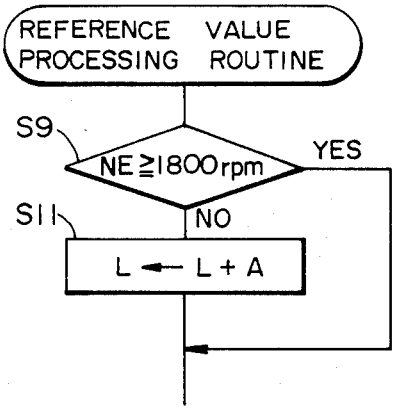
FIG. 7 is a flow chart showing a routine for varying the reference value on the basis of the engine speed in accordance with the second embodiment.
Figure 6:
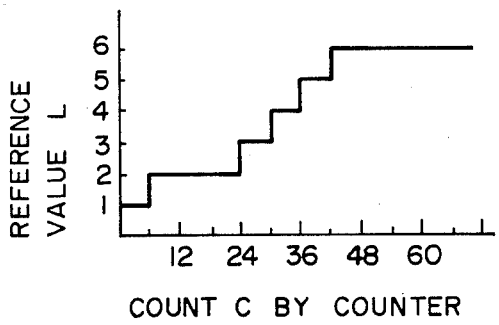
FIG. 6 is a graph showing the map of a reference value with respect to the count by a counter in accordance with a second embodiment of the present invention.

FIG. 7 shows a reference value processing routine for varying the reference value L in accordance with the engine speed NE. In a step S9, a judgement is made as to whether the engine speed NE is not less than a predetermined value (1,800 r.p.m., for example). Only when the engine speed is less than the predetermined value, the process proceeds to a step S11 in which a positive predetermined value A is added to the reference value L to increase the latter. This is intended to prevent the execution of any asynchronous injection in the low engine speed region, since the ripple of the intake-pipe pressure due to the fluctuation of the engine speed is large in the region, even during the stationary traveling state, not to mention a transient period of the engine. From this point of view, as shown in FIG. 6, the reference value L is increased in accordance with time from the point of time when the throttle switch changes from ON to OFF and further increased in the low engine speed region and is then stored at a given address in the RAM.

Figure 8:
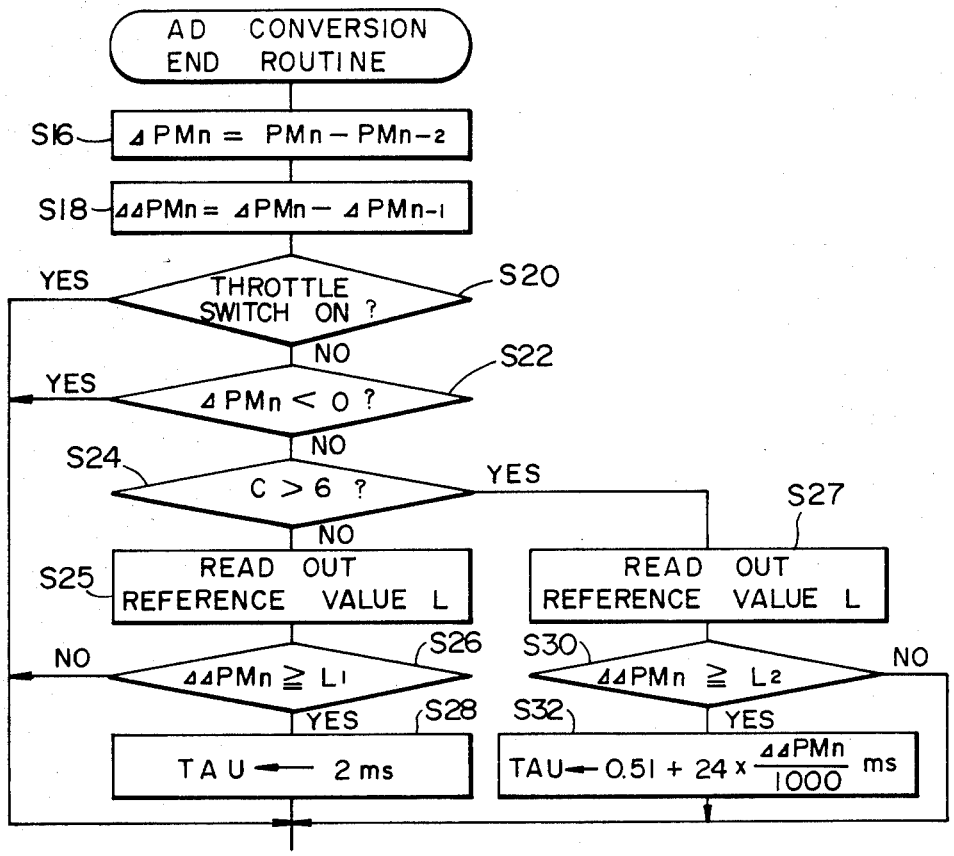
FIG. 8 is a flow chart showing an asynchronous injection routine in accordance with the second embodiment.

FIG. 8 shows a routine for calculating the pulse width TAU of the fuel injection signal during the asynchronous injection through the judgement of an engine acceleration state. Since FIG. 8 is similar to FIG. 5, the like portions are denoted by the like reference numerals, and the description thereof is omitted. However, the routine in FIG. 8 is additionally provided with steps S25, S27 for reading out the reference value L from the RAM. Since the reference value L differs according to the count C by the counter, a reference value when $C<6$ is defined as a first reference value $L_1$, and a reference value when $C \geqq 6$ is defined as a second reference value $L_2$. Increasing the reference value in the low engine speed region as described above prevents any asynchronous injection from taking place in the low engine speed region, resulting in an improvement in driveability.

A third embodiment of the present invention will be explained hereinunder. Since the main routine and 4 msec routine in accordance with this embodiment are the same as those shown in FIGS. 3 and 4, respectively, the description thereof is omitted. The ROM 38 has previously stored therein data on the first and second quantities for the asynchronous fuel injection and the map shown in FIG. 6.

Figure 9:
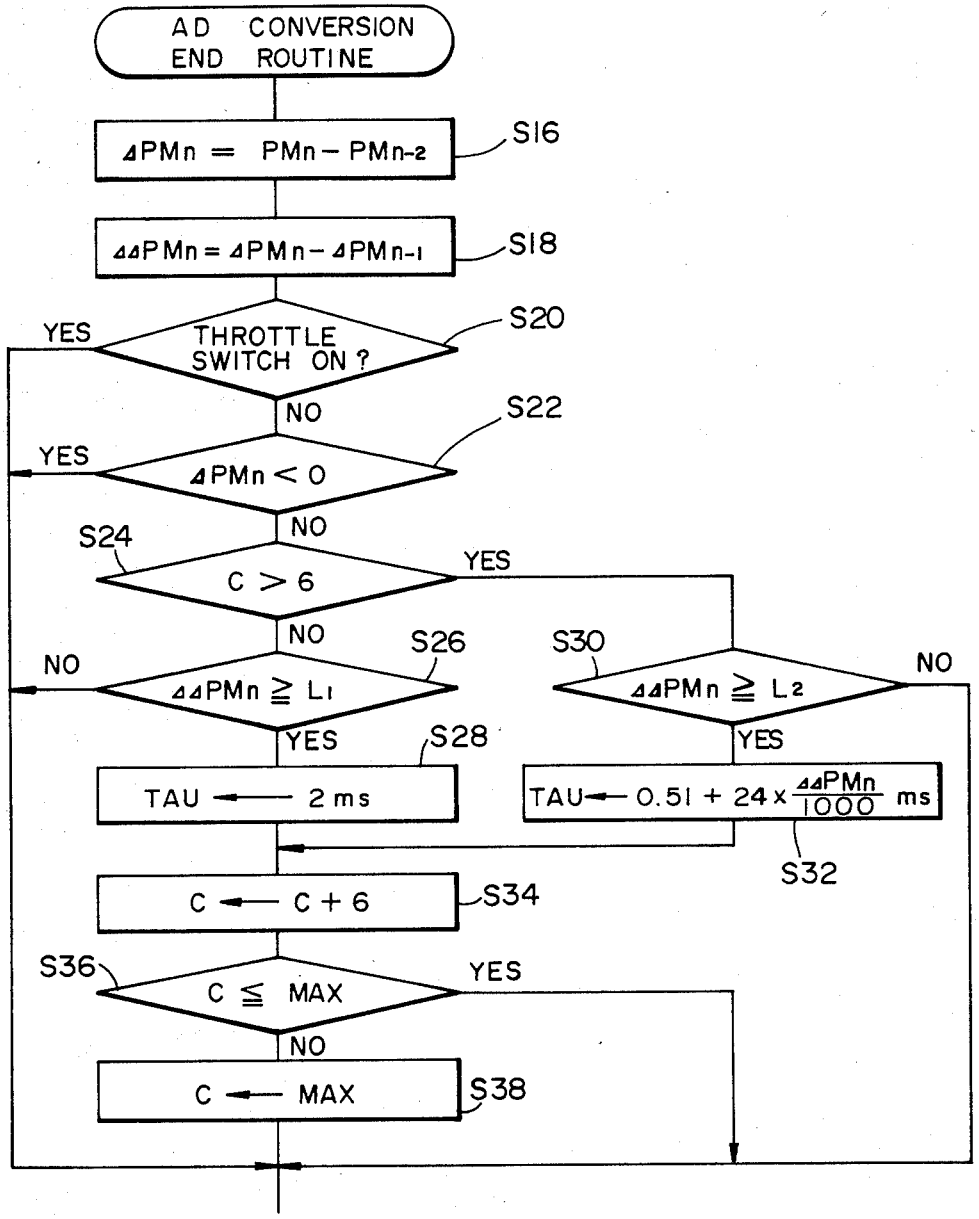
FIG. 9 is a flow chart showing an asynchronous injection routine in accordance with a third embodiment of the present invention.

FIG. 9 shows a routine for calculating the pulse width of the fuel injection signal in the asynchronous injection through the judgement of an engine acceleration state. Since FIG. 9 is similar to FIG. 5, the like portions are denoted by the like reference numerals, and the description thereof is omitted. However, FIG. 9 is additionally provided with steps S34, S36 and S38. It is to be noted that the reference values $L_1$ and $L_2$ for the steps S26 and S30 are obtained from the map shown in FIG. 6 in the same manner as that in the second embodiment.

In the step S34, a predetermined value (six, for example) is added to the count C obtained by the counter, and a judgement is made in a step S36 as to whether the count C exceeds a maximum value MAX or not. If the maximum value MAX is exceeded, the count C is set at the maximum value MAX in the step S38. Thus, since after the asynchronous injection is executed in the steps S28 and S32, the count C by the counter is incremented and the reference value is set so as to increase in accordance with the count C, the reference value is consequently increased after the asynchronous injection, so that the number of times of asynchronous injections is reduced with the elapse of time.

Figure 10:
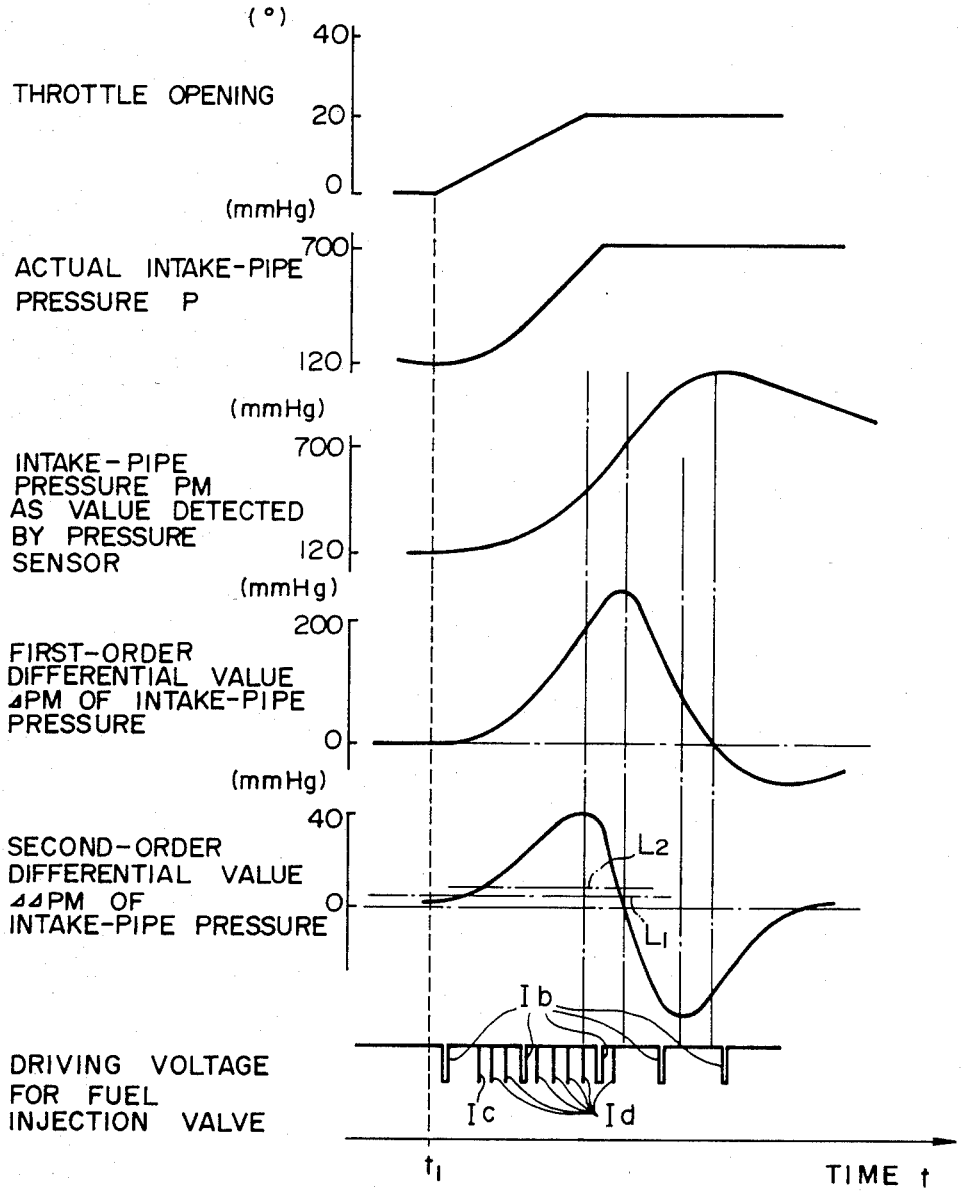
FIG. 10 is a graph showing the change with time of a driving voltage for a fuel injection valve and the like during acceleration of the engine in each of the above embodiments.

FIG. 10 shows the change with time of the throttle opening, the actual intake-pipe pressure P, the intake-pipe pressure PM detected by the pressure sensor, the first-order differential value ΔPM of the intake-pipe pressure PM, the second-order differential value ΔΔPM of the intake-pipe pressure PM and the driving voltage for the fuel injection valve during an engine acceleration in each of the above-described embodiments. During the period when the driving voltage is at a low level, the fuel injection valve is maintained at open position to inject fuel. When acceleration of the engine is started at a time $t_1$, the throttle opening increases from 0°. Consequently, the actual intake-pipe pressure P increases, and the intake-pipe pressure PM as a value detected by the pressure sensor also increases. The intake-pipe pressure PM has an overshoot. A pulse Ib represents a synchronous injection in which fuel is injected in synchronism with the crank angle. The synchronous injection quantity corresponds to a quantity obtained by correcting the basic injection quantity, which is determined in accordance with the intake-pipe pressure PM and the engine speed, by the engine-cooling water temperature and the like. A pulse Ic represents an asynchronous acceleration fuel injection effected with the execution of the step S28, in which a first quantity of fuel corresponding to the asynchronous injection pulse width (2 msec) is injected during the period after the throttle valve at fully closed position is opened until a predetermined period of time has elapsed and when ΔΔPMn is not less than the first reference value $L_1$. A pulse Id represents an asynchronous acceleration fuel injection effected with the execution of the step S30, in which a second quantity of fuel corresponding to the asynchronous injection pulse width obtained in the step S32 is injected when ΔΔPMn is not less the second reference value $L_2$ after the asynchronous injection by the pulse Ic. Since ΔΔPM is larger than ΔPM in rise at the start of acceleration, the start of acceleration can be speedily and accurately detected to effect the asynchronous acceleration fuel injection. In addition, since the increase in ΔΔPM excellently reflects the increase in the throttle opening, it is possible to effect the asynchronous acceleration fuel injection in accordance with the engine acceleration state.

The following is the description of a fourth embodiment of the present invention. Since the main routine and 4 msec routine in accordance with this embodiment are the same as those in FIGS. 3 and 4, respectively, the description thereof is omitted. The ROM 38 has previously stored therein data on the first and second quantities for the asynchronous injection and the map shown in FIG. 6.

Figure 11:
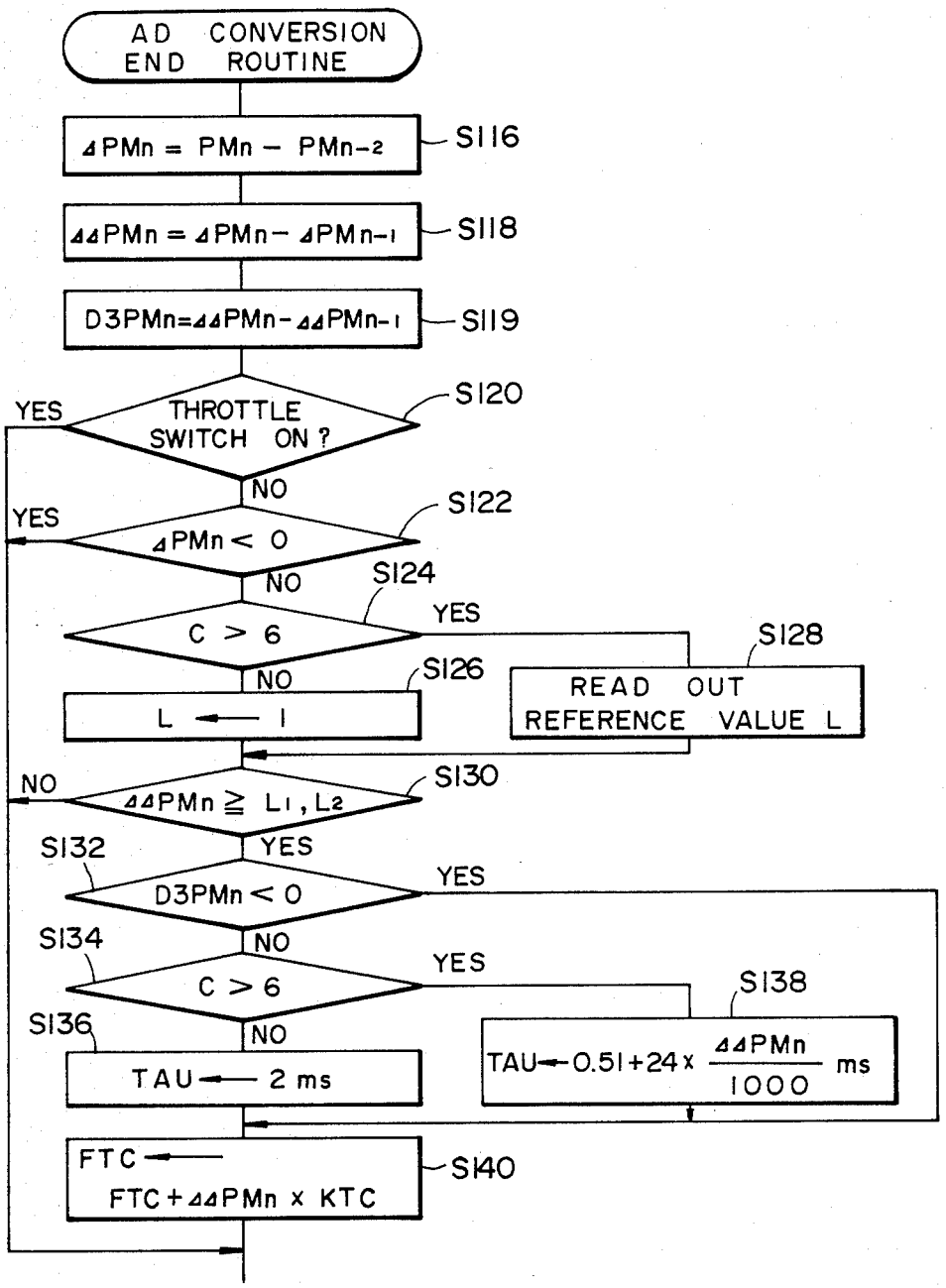
FIG. 11 is a flow chart showing an asynchronous injection routine in accordance with a fourth embodiment of the present invention.

FIG. 11 shows a routine for calculating the pulse width TAU of the fuel injection signal in the asynchronous injection through the judgement of an engine acceleration state as well as for calculating the acceleration correction coefficient ETC in the synchronous injection. This routine is interrupted when the AD conversion of the intake-pipe pressure PM is completed. It is to be noted that the AD conversion of the intake-pipe pressure PM is carried out every 12 msec. In a step S126, calculation is performed to obtain the difference between the intake-pipe pressure PMn measured this time and the intake-pipe pressure PMn-2 measured before the last time, that is, 24 msec before to calculate the quantity of change, that is, the change rate ΔPMn of the intake-pipe pressure during 24 msec. This change rate ΔPMn is equivalent to the first-order differential of the intake-pipe pressure PM with respect to time. In a step S118, calculation is carried out to obtain the difference between the change rate ΔPMn calculated this time and the change rate ΔPMn-1 calculated the last time, that is, 12 msec before to calculate the quantity of change of the change rate, that is, the rate ΔΔPMn of change of the change rate of the intake-pipe pressure during 12 msec. This change rate ΔΔPMn is equivalent to the second-order differential of the intake-pipe pressure PM with respect to time. In a step S119, calculation is carried out to obtain the difference between the change rate ΔΔPMn calculated this time and the change rate ΔΔPMn-1 calculated the last time, that is, 12 msec before to calculate the quantity of change of the change rate, that is, the rate D3PMn of change of the change rate of the change rate of the intake-pipe pressure during 12 msec. This change rate D3PMn is equivalent to the third-order differential of the intake-pipe pressure PM with respect to time.

In a step S120, a judgement is made as to whether the throttle switch is ON or OFF, and a judgement is made in a step S122 as to whether the first-order differential value ΔPMn of the intake-pipe pressure is negative or not. Only when the throttle switch is OFF and the first-order differential value ΔPMn is not less than 0, the following steps are executed. Accordingly, no asynchronous injection is effected when the first-order differential value ΔPMn is negative, that is, during deceleration. In a subsequent step S124, a judgement is made as to whether the count C by the counter exceeds a predetermined value (six, for example) or not. If the count C is not exceeding six, the process proceeds to a step S126 in which the reference value L is set at one, and then proceeds to a step S130. If the count C exceeds six, in a step 128, a reference value L corresponding to the count is read out from the map in the ROM, and then the process proceeds to the step S130. Since this reference value L differs according to the count C by the counter as shown in FIG. 6, a reference value when $C \leqq 6$ is defined as $L_1$, while a reference value when $C > 6$ is defined as $L_2$.

In the step S130, a judgement is made as to whether the second-order differential value ΔΔPMn of the intake-pipe pressure is not less than the reference values $L_1$, $L_2$. If the second-order differential value ΔΔPMn is not less than the reference values $L_1$, $L_2$, a judgement is made in a step S132 as to whether the third-order differential value D3PMn of the intake-pipe pressure is negative or not. Only when the third-order differential value D3PMn of the intake-pipe pressure is not negative, a judgement is made in a step S134 as to whether the count C by the counter exceeds a predetermined value (six, for example) or not.

When the count C is not exceeding six, the process proceeds to a step S136 in which the asynchronous injection pulse width TAU is set at a predetermined value (2 msec, for example). As a result, the first quantity of fuel corresponding to the asynchronous injection pulse width TAU is asynchronously injected during an engine acceleration period from the point of time when the throttle valve at fully closed position is opened until a predetermined time (24 msec) has elapsed.

On the other hand, when the count C exceeds six, process proceeds to a step S138 in which the asynchronous injection pulse width TAU is determined by the above-mentioned equation (1).

As a result, the second quantity of fuel corresponding to the asynchronous injection pulse width TAU proportional to the second-order differential value ΔΔPMn of the intake-pipe pressure is injected after the predetermined period of time has elapsed.

It is to be noted that since the reference value L is set to be positive and no asynchronous injection is effected when the third-order differential value D3PMn is negative, no asynchronous injection is conducted during the stationary travel (ΔPMn=0) and a slow acceleration (ΔPMn=constant) in which ΔΔPMn is zero, and after the acceleration early stage when D3PMn is negative.

The synchronous injection in accordance with this embodiment will be described hereinunder. In this synchronous injection, fuel is injected from the fuel injection valve every crank angle of 360°, and the synchronous injection pulse width TAU therefor is determined by the following equation:

$$TAU = TP \times f(k) \times (1 + FTC) \quad (2)$$

where, TP represents a basic fuel injection time width determined by the intake-pipe pressure PM and the engine speed NE; f(k) a correction coefficient determined by the intake-air temperature signal, the air-fuel ratio signal, etc; and FTC a correction coefficient in acceleration of the engine.

The acceleration correction coefficient FTC is determined by the following equation (3):

$$FTC = \text{Max}\ (FTCLL, FTCDDPM, FTCPM) \quad (3)$$

where, Max denotes a function representing a maximum value; FTCLL a constant acceleration coefficient at the point of time when the throttle switch changes from ON to OFF; FTCDDPM an acceleration coefficient with respect to the second-order differental value ΔΔPMn; and FTCPM an acceleration coefficient with respect to the first-order differential value ΔPMn. The acceleration coefficients ETCDDPM, FTCPM are determined by the following equations, respectively:

$$FTCDDPM = \Sigma\Delta\Delta PMn \times KTC \quad (4)$$

$$FTCPM = \Sigma\Delta PMn \times KTC \quad (5)$$

Figure 12:
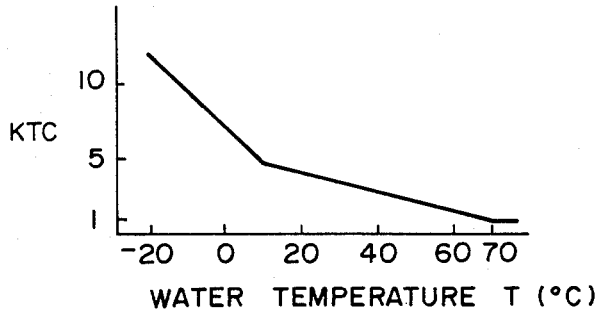
FIG. 12 is a graph showing a map of a correction coefficient with respect to the water temperature in accordance with the fourth embodiment.

In addition, the above-mentioned constant KTC is varied so as to decrease as the engine-cooling water temperature T rises, as shown in FIG. 12. This constant KTC is previously stored in the ROM in the form of a map.

It is to be noted that the above-mentioned acceleration coefficients FTCLL, FTCDDPM, FTCPM are attenuated with time.

As the result of determination of the acceleration correction coefficient FTC as described above, the correction coefficient FTC becomes equal to the acceleration coefficient FTCLL at the point of time when the throttle valve changes from ON to OFF, and is then varied in accordance with the second-order differential value ΔΔPMn as well as the engine-cooling water temperature, and the first-order differential value ΔPMn as well as the engine-cooling water temperature.

After the execution of the above-described asynchronous injection, in a step S140 shown in FIG. 11, the correction coefficient FTC for the present acceleration is obtained by adding the correction coefficient FTC for the previous acceleration to a value obtained by multiplying the constant KTC read out from the map in the ROM in accordance with the engine-cooling water temperature T and the second-order differential value ΔΔPMn of the intake-pipe pressure obtained in the step S118. Then, the fuel injection pulse width TAU in the synchronous injection is obtained through the above-mentioned equation (2) to inject fuel. It is to be noted that this synchronous injection is applicable to the first embodiment to the third embodiment.

Figure 13:
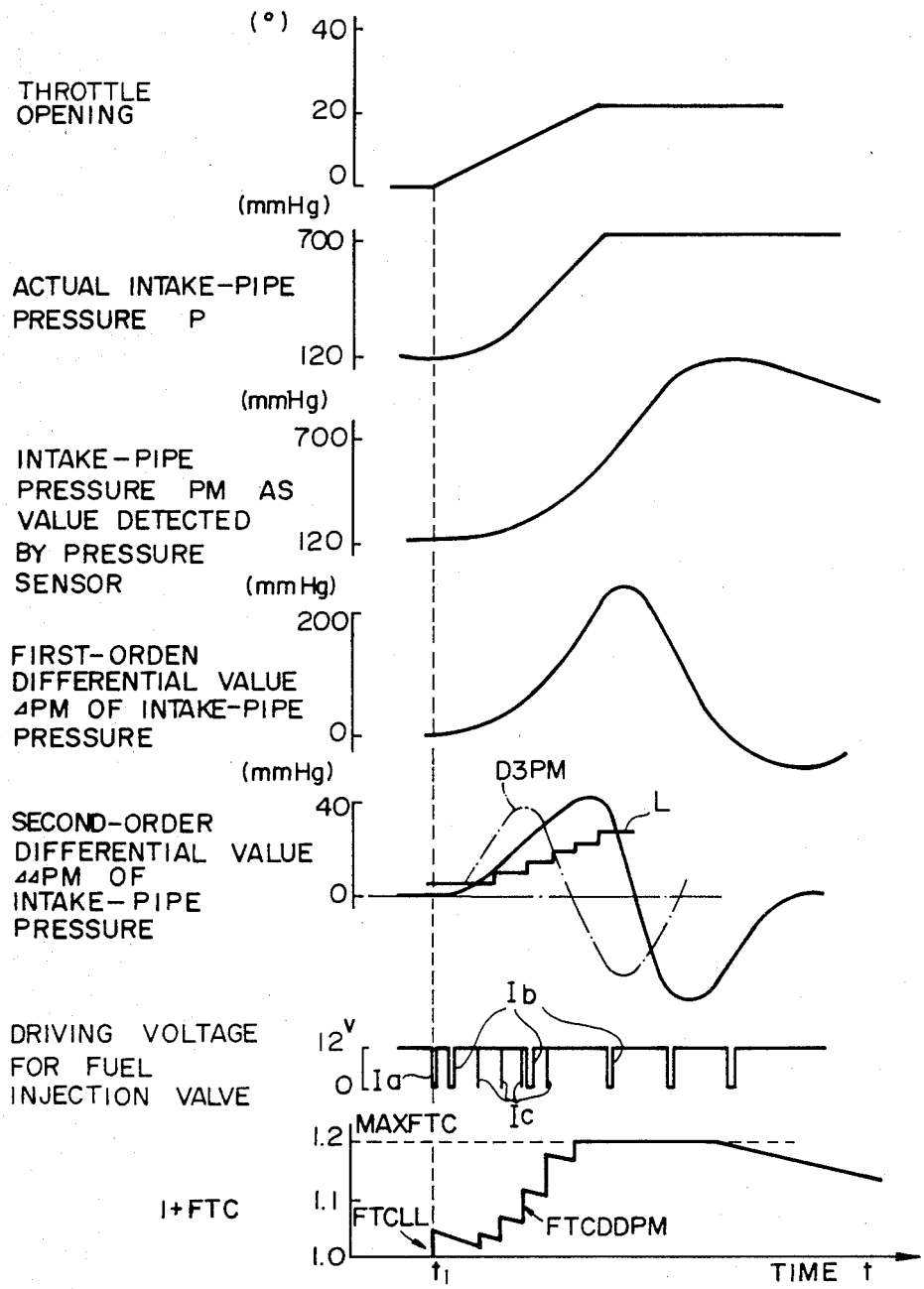
FIG. 13 is a graph showing the change with time of a driving voltage for a fuel injection valve and the like during acceleration of the engine in accordance with the fourth embodiment.

FIG. 13 shows the change with time of the throttle opening, the actual intake-pipe pressure P, the intake-pipe pressure PM detected by the pressure sensor, the first-order differential value ΔPM of the intake-pipe pressure PM, the second-order differential value ΔΔPM of the intake-pipe pressure PM, the third-order differential value D3PM, the correction coefficient FTC and the driving voltage for the fuel injection valve during acceleration of the engine in this embodiment. During the period when the driving voltage is at a low level, the fuel injection valve is maintained at open position to inject fuel. When acceleration of the engine is started at a time $t_1$, the throttle opening increases from 0°. In consequence, the actual intake-pipe pressure P increases, and the intake-pipe pressure PM as a value detected by the pressure sensor also increases. The intake-pipe pressure PM has an overshoot. A pulse Ia represents an asynchronous acceleration fuel injection effected when the throttle switch changes from ON to OFF. A pulse Ib represents a synchronous acceleration fuel injection carried out when it is corrected by the acceleration coefficient FTCDDPM. In addition, a pulse Ic represents an asynchronous acceleration fuel injection conducted with the execution of the steps S136 and S138. Since ΔΔPM is larger than ΔPM in rise at the start of acceleration, the start of acceleration can be speedily and accurately detected to carry out the asynchronous acceleration fuel injection. Further, since the increase in ΔΔPM excellently reflects the increase in the throttle opening, it is possible to effect the asynchronous acceleration fuel injection in accordance with the engine acceleration state.

It is to be noted that although in each of the above embodiments the invention has been described through the engine in which the basic fuel injection quantity is calculated based on the intake-pipe pressure and the engine speed, the invention is applicable to an engine in which the basic fuel injection quantity is calculated based on the intake-air quantity Q per revolution of the engine shaft and the engine speed. In this case, PMn, ΔPMn, ΔΔPMn and D3PMn are replaced by Qn, ΔQn, ΔΔQn and D3Qn, respectively. In addition, it is also possible to determine the asynchronous injection timing from the differential value of function with the throttle opening and the fuel injection pulse width taken as variables, in the same manner as that in the described embodiment.

Since each of the described embodiments does not employ any linear throttle sensor but a contact-type throttle sensor, the structure is simplified and the cost is reduced, advantageously. Moreover, driveability is improved, since the synchronous acceleration fuel injection quantity is increased in accordance with the second-order differential value of the intake-pipe pressure in the cold state of the engine.

What is claimed is:

1. A method of electronically controlling a fuel injection for an internal combustion engine wherein fuel is injected in asynchronism with a crank angle when a throttle valve is open and a rate of change of an engine load takes a positive value, comprising the steps of:

obtaining a second-order differential value of the engine load with respect to time defined as the rate of change of a change rate of the engine load;

injecting a first quantity of fuel during a period after a point of time when the throttle valve at fully closed position is opened until a predetermined period of time has elapsed and when said second-order differential value is not less than a first reference value; and injecting a second quantity of fuel after said predetermined period of time has elapsed and when said second-order differential value is not less than a second reference value.

2. A method of electronically controlling a fuel injection for an internal combustion engine according to claim 1, wherein said first and second reference values are increased in accordance with time from the point of time when the throttle valve at fully closed position is opened.

3. A method of electronically controlling a fuel injection for an internal combustion engine according to claim 1, wherein said second quantity of fuel is increased as said second-order differential value increases.

4. A method of electronically controlling a fuel injection for an internal combustion engine according to claim 2, wherein said second quantity of fuel is increased as said second-order differential value increases.

5. A method of electronically controlling a fuel injection for an internal combustion engine wherein fuel is injected in asynchronism with a crank angle when a throttle valve is open and the rate of change of an engine load takes a positive value, comprising the steps of:

obtaining a time based on a point of time when the throttle valve at fully closed position is opened, as well as determining a reference value which is increased in accordance with said time;

obtaining a second-order differential value of the engine load with respect to time defined as the rate of change of a change rate of the engine load;

injecting a first quantity of fuel when said time is not exceeding a predetermined period of time and said second-order differential value is not less than said reference value; and injecting a second quantity of fuel when said time exceeds said predetermined period of time and said second-order differential value is not less than said reference value.

6. A method of electronically controlling a fuel injection for an internal combustion engine according to claim 5, wherein said second quantity of fuel is increased as said second-order differential value increases.

7. A method of electronically controlling a fuel injection for an internal combustion engine according to claim 5, wherein said reference value, which is increased in accordance with time, is further increased by a predetermined quantity in a low engine speed region.

8. A method of electronically controlling a fuel injection for an internal combustion engine according to claim 6, wherein said reference value, which is increased in accordance with time, is further increased by a predetermined quantity in a low engine speed region.

9. A method of electronically controlling a fuel injection for an internal combustion engine according to claim 5, wherein said reference value, which is increased in accordance with time, is further increased by a predetermined quantity after the injection of fuel.

10. A method of electronically controlling a fuel injection for an internal combustion engine according to claim 9, wherein said second quantity of fuel is increased as said second-order differential value increases.

11. A method of electronically controlling a fuel injection for an internal combustion engine according to claim 9, wherein said reference value, which is increased in accordance with time, is further increased by a predetermined quantity in a low engine speed region.

12. A method of electronically controlling a fuel injection for an internal combustion engine according to claim 10, wherein said reference value, which is increased in accordance with time, is further increased by a predetermined quantity in a low engine speed region.

13. A method of electronically controlling a fuel injection for an internal combustion engine wherein fuel is injected in asynchronism with a crank angle when a throttle valve is open and the rate of change of an engine load takes a positive value, comprising the steps of:

obtaining a second-order differential value of the engine load with respect to time which is defined as the rate of change of a change rate of the engine load, and a third-order differential value of the engine load with respect to time which is defined as the rate of change of said second-order differential value;

injecting a first quantity of fuel during a period from a point of time when the throttle valve at fully closed position is opened until a predetermined period of time has elapsed and when said second-order differential value is not less than a first reference value and said third-order differential value is not negative; and injecting a second quantity of fuel after said predetermined period of time has elapsed and when said second-order differential value is not less than a second reference value and said third-order differential value is not negative.

14. A method of electronically controlling a fuel injection for an internal combustion engine according to claim 13, wherein said first and second reference values are increased in accordance with time from the point of time when the throttle valve at fully closed position is opened.

15. A method of electronically controlling a fuel injection for an internal combustion engine according to claim 13, wherein said first and second reference values are obtained from a reference value which is increased in accordance with time based on the point of time when the throttle valve at fully closed position is opened.

16. A method of electronically controlling a fuel injection for an internal combustion engine according to claim 13, wherein said second quantity of fuel is increased as said second-order differential value increases.

* * * * *